US006360901B1

(12) United States Patent
Parham

(10) Patent No.: US 6,360,901 B1
(45) **Date of Patent: *Mar. 26, 2002**

(54) BOTTLE NECK-HANGING DISPLAY DEVICE ADAPTABLE FOR DIFFERENT NECK SIZES

(75) Inventor: Dennis E. Parham, Kennesaw, GA (US)

(73) Assignee: Display Industries, LLC., Smyrna, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/971,332

(22) Filed: Nov. 17, 1997

(51) Int. Cl.[7] ..... A47F 1/04

(52) U.S. Cl. ..... 211/59.2; 211/49.1; 211/162; 211/74; 211/183; 312/45; 312/42; 221/298; 221/289; 221/124

(58) Field of Search ..... 211/74, 59.2, 59.3, 211/175, 126.15, 49.1, 151, 162, 192, 193, 183, 182, 189; 312/42, 35, 45; 248/312, 312.1, 243; 221/298

(56) References Cited

U.S. PATENT DOCUMENTS 1,975,622 A * 10/1934 Schermerhorn ..... 211/183 X
2,902,166 A * 9/1959 Bahr ..... 211/189 X
2,925,181 A * 2/1960 Saul, Jr. et al. ..... 211/191
3,164,255 A * 1/1965 Jay ..... 211/193 X
3,244,290 A * 4/1966 Kaufman et al. ..... 211/192 X
3,637,087 A * 1/1972 Denny ..... 211/192
3,936,024 A * 2/1976 Jung ..... 248/243
4,019,638 A * 4/1977 Miller ..... 211/174
4,095,385 A * 6/1978 Brugman ..... 52/762 X
4,285,436 A * 8/1981 Konstant et al. ..... 211/192
4,310,097 A * 1/1982 Merl ..... 312/45
4,356,923 A * 11/1982 Young et al. ..... 312/45 X
4,367,818 A * 1/1983 Suttles ..... 211/162 X
4,401,221 A * 8/1983 Suttles ..... 211/74 X
4,423,816 A * 1/1984 Suttles ..... 211/183
4,664,265 A * 5/1987 George, Jr. ..... 211/189 X
4,714,192 A * 12/1987 Harlow, Jr. et al. . 211/126.15 X
5,476,180 A * 12/1995 Konstant ..... 211/151
5,586,665 A * 12/1996 Brousseau ..... 211/175 X
5,586,687 A * 12/1996 Spamer et al. ..... 211/74
5,645,176 A * 7/1997 Jay ..... 211/59.3 X
5,669,527 A * 9/1997 Hardy ..... 211/74 X
5,706,957 A * 1/1998 Hardy ..... 211/59.2
5,706,958 A * 1/1998 Spamer ..... 211/59.2
5,706,978 A * 1/1998 Spamer et al. ..... 211/59.2 X
5,718,341 A * 2/1998 Robertson ..... 211/59.2
5,779,068 A * 7/1998 Whiten et al. ..... 211/59.2 X
5,788,090 A 8/1998 Kajiwara ..... 211/59.2
5,788,091 A * 8/1998 Robertson et al. ..... 211/59.2

* cited by examiner

*Primary Examiner*—Alvin Chin-Shue
*Assistant Examiner*—Khoa Tran
(74) *Attorney, Agent, or Firm*—John L. James

(57) ABSTRACT

A merchandising device is useful to display flanged bottles. The device includes an elongate track for supporting a row of flanged bottles such that the bottles in the row are suspended by their neck flanges for movement along the track and are removable from the track through the front end of the track. The track comprises a track body including a pair of opposed side walls extending along the track, and a pair of rail members detachably attached respectively to the side walls of the body to be disposed substantially parallel to each other. Each rail member comprises a connector panel extending alongside a respective one of the side walls and a supporting ledge joined to and extending along the panel. The ledges of the rail members project laterally of the panels toward each other and are disposed with a gap therebetween to receive in the gap the necks of the bottles such that the bottles are slidably engaged at the undersides of their neck flanges with the ledges.

8 Claims, 6 Drawing Sheets

BOTTLE NECK-HANGING DISPLAY DEVICE ADAPTABLE FOR DIFFERENT NECK SIZES

BACKGROUND OF THE INVENTION

This invention relates to merchandising or storing devices for soft drink bottles, and particularly to a neck-hanging type bottle dispensing device in which bottles are suspended by their neck flanges and carried forward by gravity on an inclined track.

Merchandising devices of the neck-hanging type have been used in the merchandising of soft drink bottles such as PET bottles having outwardly projecting annular neck flanges. These devices have an elongate track having a pair of opposed parallel rails integrally formed with and extending along the track. The necks of flanged bottles are received in the gap between the track rails so that the bottles are engaged at their neck flanges with the rails and thus suspended by their necks. The bottles are automatically arranged in a row along the track as they are loaded into the track. The track is normally inclined downwardly toward its front end and thus the suspended bottles are allowed to gravity feed one after another to the front end as the leading or foremost bottles in the row are removed from the track through the front end. A length of the track adjacent to the front end is upturned relative to the remainder of the track to stop each leading bottle at the front end and to thereby present it for removal from the track.

Soft drink bottles are currently available in many different sizes, e.g., 28 mm, 38 mm and 42 mm, which sizes refer to neck diameters. In these circumstances, it is desirable to provide the merchandising devices with a convertibility feature so that any bottle size can be accommodated.

One form of conventional neck-hanging merchandising device adaptable for different neck diameters is disclosed in U.S. Pat. No. 4,318,484 which is owned by the assignee of the present invention. In this patent, convertibility is achieved by providing detachable plastic strips that can be pressed onto the rails of a track to reduce the size of the gap between the track rails. This solution requires substantial friction between each strip and the associated track rail to keep the strip on the rail against the load applied by the suspended bottles. Such a requirement contradicts with a preferred track arrangement wherein the rails and the strips are formed from, or at least coated with, low friction material to minimize friction between the track and the suspended bottles.

What is needed, therefore, is an improved neck-hanging type merchandising device in which detachable members for adjusting the track gap size can be securely attached to the track body while conventional low friction materials are used for both the track body and the detachable members.

SUMMARY OF THE INVENTION

In meeting the foregoing needs, the present invention provides a neck-hanging type merchandising device including an elongate track for slidably supporting a row of flanged bottles. The track comprises a track body including a pair of opposed side walls extending along the track, and a pair of rail members detachably attached to the side walls of the body, respectively. Each rail member comprises a connector panel extending alongside the respective side wall and a supporting ledge joined to and extending along the panel. The ledges of the rail members project laterally of the panels toward each other and are disposed with a gap therebetween to receive in the gap the necks of the bottles such that the bottles are slidably engaged at the undersides of the neck flanges with the ledges. The track further comprises means for detachably attaching the connector panels of the rail members to the side walls, respectively.

According to the invention, the rail members of different ledge widths can be interchangeably used to accommodate bottles of different neck diameters. The connector panels of the rail members are attached to the side walls of the track body to assure the secure engagement between the body and the members without use of any friction material.

According to a preferred embodiment of the invention, the body further includes a top wall which interconnects the upper edges of the side walls to form an elongate channel structure. The connector panel of each rail member is disposed, preferably, alongside the inside surface of the respective side wall although it may be located alongside the outside surface of the respective side wall.

In another preferred embodiment, the ledge of each rail member is joined to the respective panel along its lower edge to form an elongate member of a generally L-shaped cross section.

In still another preferred embodiment, the attaching means comprises at least one locking element formed on each rail member and at least one cooperating locking aperture formed in the respective side wall to receive the one locking element of that rail member.

A preferred form of the attaching means requires each rail member to have a front end projecting forwardly of the front edge of the respective side wall. In the attachment means of the preferred form, the one locking element extends rearwardly from the front end of each rail member to engage the perimeter of the one locking aperture formed adjacent to the front edge of the respective side wall.

In an alternative form of the attaching means, the at least one locking aperture in the respective side wall are keyhole apertures formed along the lower edge of the respective side wall, and the at least one locking element of each rail member are headed projection.

In another alternative form of the attaching means, the attaching means further includes a plurality of engaging elements formed on and arranged longitudinally along the respective side wall to engage the upper edge of the panel of the adjacent rail member. In this form, the attaching means may further include a pair of flanges joined respectively to the side walls along their lower edges. These flanges on the side walls may project laterally toward each other along undersides of the adjacent ledges to support the rail members. Each flange cooperates with the engaging elements on the respective side wall to define a socket for slidably receiving the respective rail member for sliding movement along the track. Each engaging element may be a tab formed from the respective side wall. Such a tab may be turned toward the adjacent flange to provide a downwardly extending portion for engagement with the panel of the adjacent rail member. Preferably, the width or lateral size of the flanges is no greater than that of the ledges.

In a further preferred embodiment, the track further comprises stopper means for engagement with the leading bottle in the row to prevent the leading bottle from exiting the front end of the track. The front end of the track may be defined by the respective front ends of the rail members, and the stopper means may include the respective lengths of the rail members adjacent to the front ends of the rail members. The length of each rail member may include a portion of its ledge upturned relative to the other portion of the ledge to provide a forwardly upwardly sloping ledge section.

In a still further preferred embodiment, the merchandising device further comprises supporting means for supporting the track such that the track is inclined downwardly toward the front. By this means, the bottles when supported by the track are allowed to gravity feed toward the front end as leading bottles in the row are removed from the track.

In a still further preferred embodiment, each rail member is formed as a discrete member separate from the body. Each rail member may molded from plastic, and the track body may be formed from metal.

The objects and advantages of the present invention will be apparent from the following description, the accompanying drawings and the appended claims.

DETAILED DESCRIPTION OF THE PREFERRED EMBODIMENT

FIGS. 1 to 6 illustrate a merchandising device of the neck-hanging type according to the invention. The device includes one or more bottle dispensing shelf units of the kind shown in FIG. 1 vertically arranged and removably mounted on a rack or supporting means (not shown). The rack may be a conventional four-post rack as shown in copending U.S. Pat. No. 5,706,958, a support assembly shown in copending U.S. application Ser. No. 08/684,357 or a different type support assembly shown in copending U.S. application Ser. No. 08/794,943, which applications are hereby incorporated by reference. Alternatively, the rack may be composed of a base having a vertically extending back wall on which unit-supporting arms are cantilevered. The device may have only one shelf unit; however, it will in general have two or more shelf units arranged one above another.

Figure 1:
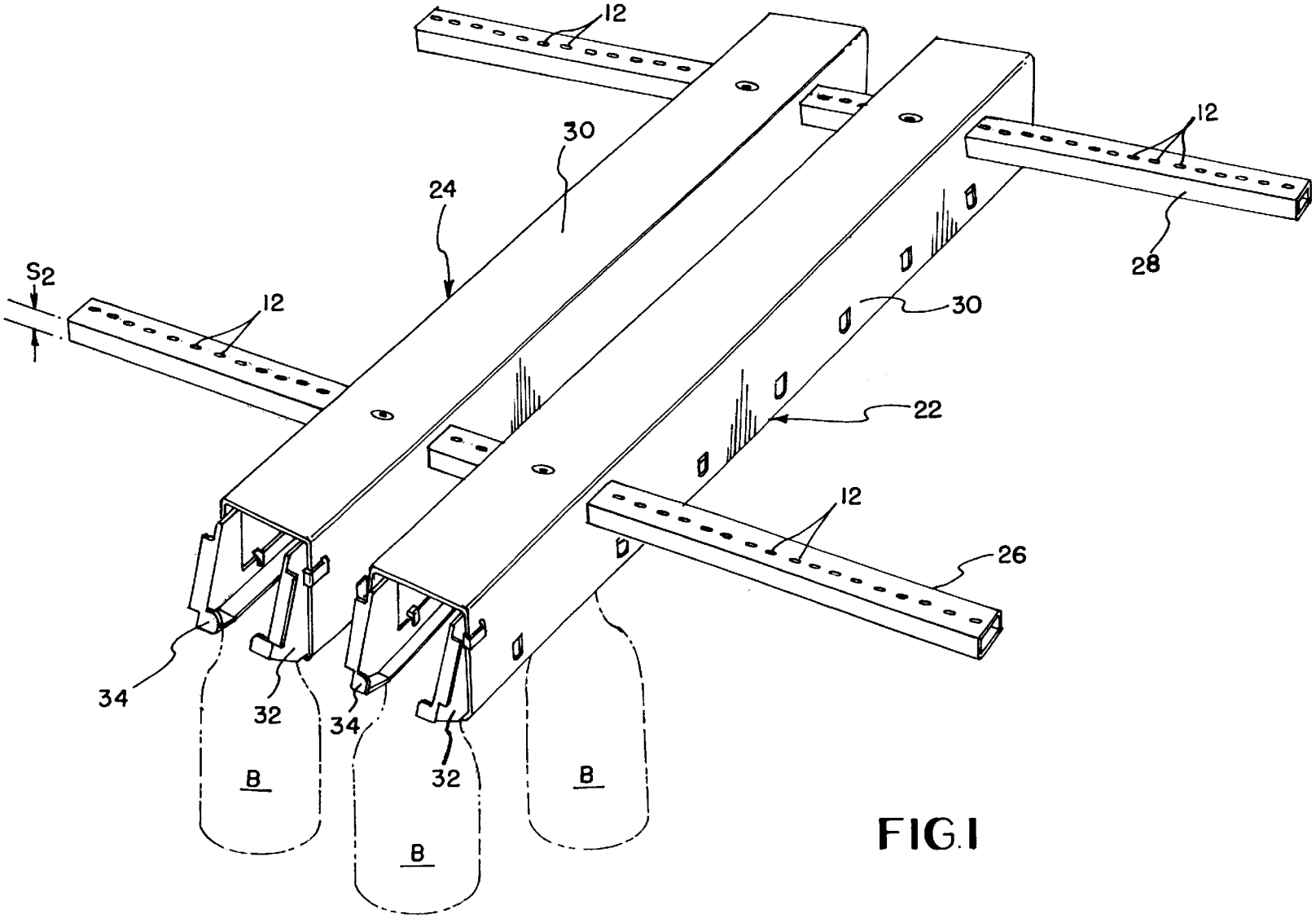
FIG. 1 is a perspective view, partially omitted, of a neck-hanging type merchandising device according to the present invention.

The shelf unit in FIG. 1 has two or more (typically five to nine) substantially parallel elongate tracks 22 and 24 interconnected through a pair of front and rear transverse support members 26 and 28. The number of the tracks used to assemble the shelf unit is determined such that the size of the shelf unit is suitable for placement on an existing rack or supporting means in a retail store in which the unit is desired to be installed. The tracks 22 and 24 are virtually identical to each other, and so are the front and rear transverse members 26 and 28. Accordingly, the details will hereinafter be described regarding primarily the track 22 and the front transverse member 26. Those portions of the track 24 identical to the track 22 are identified by the same reference numerals, and those of the member 28 identical to the member 26 are denoted by the same reference numerals.

The transverse member 26 may be formed of metal or plastic and preferably of metal. The member 26 is designed to be removably mounted on the aforementioned rack so that the shelf unit is supported at a suitable elevation above a floor. As shown in FIG. 1, the transverse member 26 is of a tubular construction having a generally rectangular cross section. The upper wall of the transverse member 26 is formed with a plurality of retaining apertures 12 arranged along the length of the member 26 at equal spacings.

Figure 2:
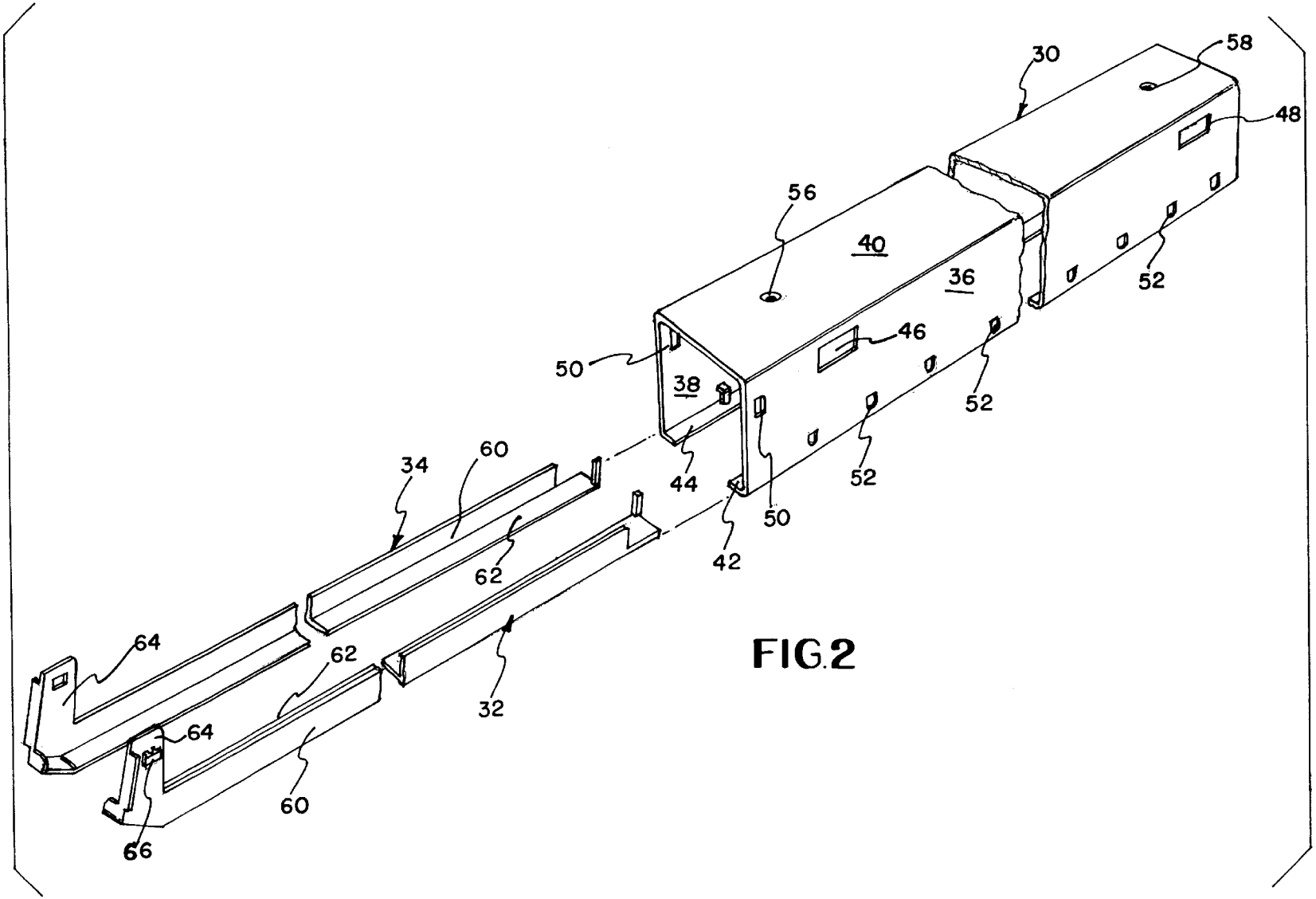
FIG. 2 is a fragmentary exploded perspective view of one of the tracks in FIG. 1.

As shown in the disassembled form in FIG. 2, the track 22 is composed of a track body 30 of a channel structure having an inverted U-shaped cross section and a pair of replaceable rail members 32 and 34 each having a L-shaped cross section. The rail members 32 and 34 are designed to be detachably attached to the track body 30. In the assembled form shown in FIG. 1, most of the length of each rail member 32 and 34 is received within the track body 30.

Figure 4:
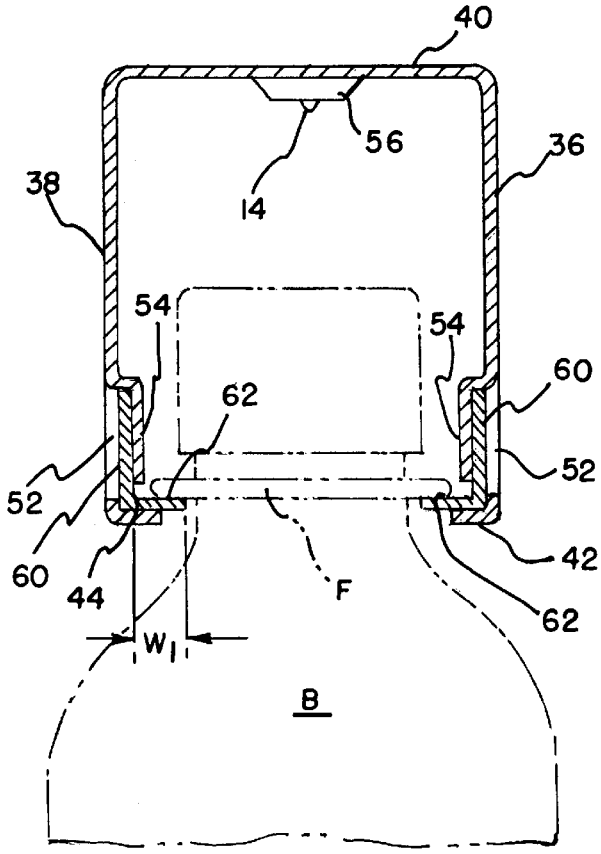
FIG. 4 is a view taken along the line IV—IV in FIG. 3.

The track body 30 may be formed of metal or plastic and preferably of metal such as steel, aluminum or aluminum compound. As best illustrated in FIGS. 2 and 4, the body 30 has a pair of longitudinally extending opposed side walls 36 and 38 joined together along their upper edges by a top wall 40. The side walls 36 and 38 and the top wall 40 in cooperation form the channel structure. A pair of elongate parallel flanges 42 and 44 are joined respectively to the side walls 36 and 38 along their lower edges. These flanges 42 and 44 project inwardly of the body 30 toward each other to support the rail members 32 and 34 which will be described later more particularly.

Figure 3:
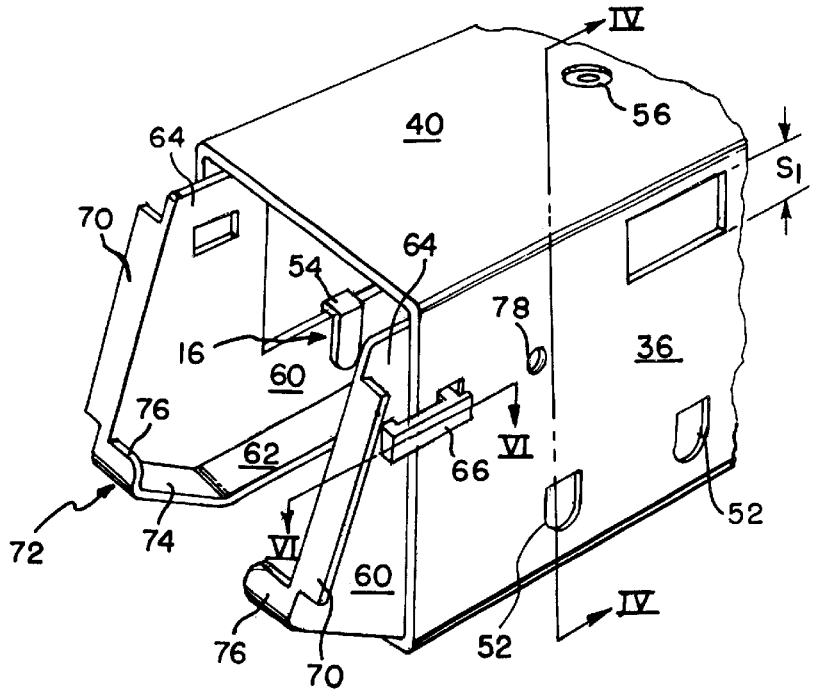
FIG. 3 is an enlarged perspective view of the front portion of the track in FIG. 1.

As best shown in FIGS. 2 and 3, the side walls 36 and 38 of the track body 30 are formed with different apertures. First, two rectangular apertures 46 and 48 are formed in each side wall 36 and 38 along the upper edge of that side wall. The apertures 46 formed near the respective front ends of the side walls 36 and 38 are identical in size and transversely opposed to each other to receive the front transverse member 26. The vertical size "S1" (shown in FIG. 3) of the apertures 46 is slightly greater than the vertical size "S2" (shown in FIG. 1) of the front transverse member 26 to facilitate insertion of the member 26 into the apertures 46. The apertures 48 formed near the respective rear ends of the side walls 36 and 38 are also identical in size and transversely opposed to each other. These apertures 48 are formed to receive the rear transverse member 28. The vertical size of the apertures 48 is also slightly greater than that of the rear transverse member 28.

Second, a pair of locking apertures 50 are formed adjacent to the front edges of the side walls 36 and 38 respectively. These apertures 50 are designed to receive latches on the rail members 32 and 34 as will be described later.

Third, a number of U-shaped apertures 52 are formed in each side wall 36 and 38 along its lower edge. They are defined as a result of formation of inwardly projecting tabs 54 (shown in FIGS. 3 and 4). More specifically, the tabs 54 are formed from the material struck from the respective side wall. Each tab 54 extends inwardly of the body 30 and then turned downwardly toward the adjacent flange of the respective side wall 36 and 38 to provide a downwardly extending portion for engagement with the respective rail member 32 and 34. These tabs 54 on each side wall 36 and 38 cooperate with the flange on the same side wall to define a socket 16

(shown in FIG. 3) for slidably receiving the respective rail member 32 and 34.

The top wall 40 of the track body 30 has a pair of anchor portions or inside projections 56 and 58 downwardly protruding therefrom. Each anchor portion 56 and 58 is formed by punching down the top wall 40 to make a downwardly projecting bead or bump that preferably has a peak 14 (shown in FIG. 4) at the center. When viewed in an imaginary top plan view, the anchor portion 56 is transversely aligned with the rectangular apertures 46 whereas the anchor portion 58 is transversely aligned with the rectangular aperture 48. The lower end 14 of each anchor portion 56 and 58 is disposed below the common plane in which the upper edges of the rectangular apertures of the associated pair lie so that the end 14 can be received in a selected one of the retaining apertures 12 of the associated transverse member 26 and 28.

The rail members 32 and 34 may be formed of metal or plastic and preferably of plastic such as acetal, nylon, polypropylene or the like. Each rail member 32 and 34 is an elongate member having a L-shaped cross section. As shown in FIGS. 2 and 4, it includes an upright connector panel 60 extending along the length of the respective rail member, and a supporting ledge 62 joined to the connector panel 60 along its lower edge. The ledges 62 of the right and left rail members 32 and 34 both project laterally of the respective panels 60; however, they project in opposite directions. In other words, the ledges 62 of the rail members 32 and 34 are formed on the inside surfaces of the connector panels 60, respectively. The width or lateral size of these ledges 62 are no less than that of the flanges 42 and 44 of the track body 30.

Figure 6:
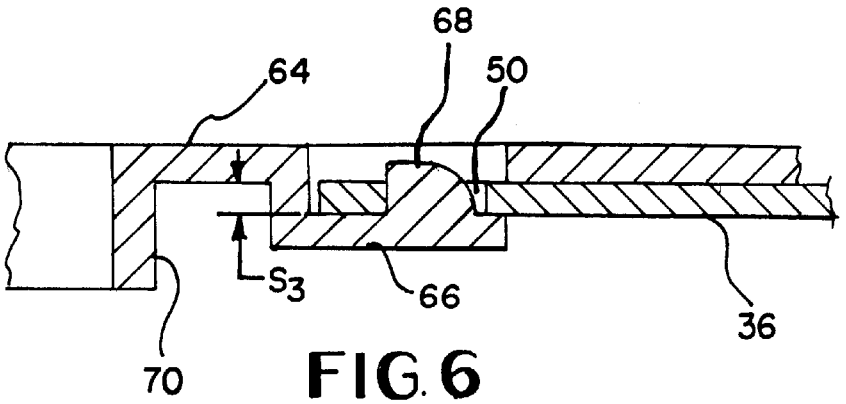
FIG. 6 is a view taken along the line VI—VI in FIG. 3.

The panel 60 of each rail member 32 and 34 is provided with an upwardly extending portion 64 at the front end of that rail member. This portion 64 has an integral latch 66 as shown in FIGS. 2, 3 and 6. The latch 66 is formed on the outside surface of the portion 64 of the respective panel 60 and extends rearward to be disposed parallel to the portion 64 with a gap therebetween. The transverse size "S3" (shown in FIG. 6) of this gap is generally equal to or slightly less than the thickness of the side walls 36 and 38. As shown in FIG. 6, a rib 68 is formed on the inside surface of the latch 66 to be received in the respective locking aperture 50.

The upwardly extending portion 64 of each rail member 32 and 34 is also provided with an outer flange 70 extending along its forward edge. These flanges 70 can be used as an end flange for supporting a bridging clip or price card holder as disclosed in a copending U.S. Pat. No. 5,718,341 which is hereby incorporated by reference. Alternatively, the flanges 70 may be used to attach a U-shaped front end cover to hide from view the front end edges of the track body 30.

Further, the front ends of the rail members 32 and 34 provide a bottle stopper 72 which is best shown in FIG. 3. The stopper 72 comprises the respective lengths of the rail members 32 and 34 adjacent to their front ends. Such a length of each rail member 32 and 34 includes a portion of the respective ledge 62 upturned relative to the remainder of that ledge 62 to provide a forwardly upwardly sloping ledge section 74 (only one shown in FIG. 3). Reference numeral 76 in FIG. 3 denotes upright forward ends of the sloping ledge sections 74. These ends 76 are greater in vertical size than the remainder of the ledge 62 and thereby prevent the ledges 62 from being mistakenly received between a cap and the adjacent neck flange of a bottle. This arrangement of the forward ends 76 is provided for convenience of front-loading of bottles. However, bottles can, of course, be back-loaded into the track 22 through the rear end opening of the track body 30.

In addition, reference numeral 78 in FIG. 3 designates an aperture in the side wall 36 for receiving an end of a pivot (not shown) extending transversely across the track body 30. The pivot swingably carries a gate or blocking mechanism disclosed in U.S. Pat. No. 5,586,687 which is hereby incorporated by reference.

The rail members 32 and 34 are attached to the track body 30 in the following manner:

The rail members 32 and 34 are inserted one by one into the track body 30 through its front end opening so that each rail member is received by the respective socket 16. This can be achieved simply by sliding each rail member rearward on the flange of the respective side wall 36 and 38 until the latch 66 on that rail member snap-engages the periphery of the locking aperture 50 in the respective side wall. The engagement of the latches 66 with the locking apertures 50 prevents longitudinal displacement of the rail members 32 and 34 and thereby locks the rail members 32 and 34 in fully inserted positions.

When the members 32 and 34 are fully inserted, the ledges 62 rest on the flanges 42 and 44, and the panels 60 are held by the tabs 54 at the respective positions where the panels 60 extend alongside the inside surfaces of the side walls 36 and 38. The ledges 62 project laterally inwardly of the side walls 36 and 38 but terminate before they reach each other. That is, a gap or space is maintained between the ledges 62 to receive the necks of flanged bottles to be displayed on the track.

According to a feature of the invention, the width or lateral size of the ledges 62 are such that when bottle necks are received between the rail members 32 and 34, the bottles are automatically arranged in a row and the undersides of the neck flanges engage the ledges 62 to allow the bottles to be suspended for sliding movement along the track 22. The ledges 62 of the rail members 32 and 34 shown in FIG. 4 are designed to accommodate large-sized bottles such as those having a neck diameter of 42 mm. A condition in which a flanged PET bottle is suspended from the track 22 is best shown in FIG. 4 wherein the bottle "B" is depicted by a phantom line whereas the bottle neck flange is denoted by "F".

The shelf unit can be assembled by inserting the front and rear transverse members 26 and 26 through the rectangular apertures 46 and 48 of the tracks 22 and 24 of a desired number. Each track can be locked in a selected position along the transverse members 26 and 28 by placing each anchor portion 56 and 58 into one of the retaining apertures 12 of each transverse member. It should be recognized that the number of the tracks on the transverse members 26 and 28 can be adjusted easily by removing the tracks of a desired number from the members 26 and 28 or by adding one or more similar tracks onto the transverse members 26 and 28.

The shelf unit thus assembled can be mounted on the rack such that each of the front and rear transverse members 26 and 28 is held substantially horizontally while the rear transverse member 28 is supported at a higher elevation than the front transverse member 26. This arrangement permits the tracks 22 and 24 to be inclined downwardly toward their respective front ends. The angle of inclination of the tracks from the horizontal may be about 1 to 20 degrees, preferably about 2 to 18 degrees and most preferably about 8 to 10 degrees. The inclination of the tracks allows the bottles on the tracks to gravity feed to the front ends of the tracks as the leading bottles in each row are removed from the tracks.

When the leading bottles in the track 22 travel along the sloping ledge sections 74 and 74, they are braked to a stop and presented for removal from the track 22.

Figure 5:
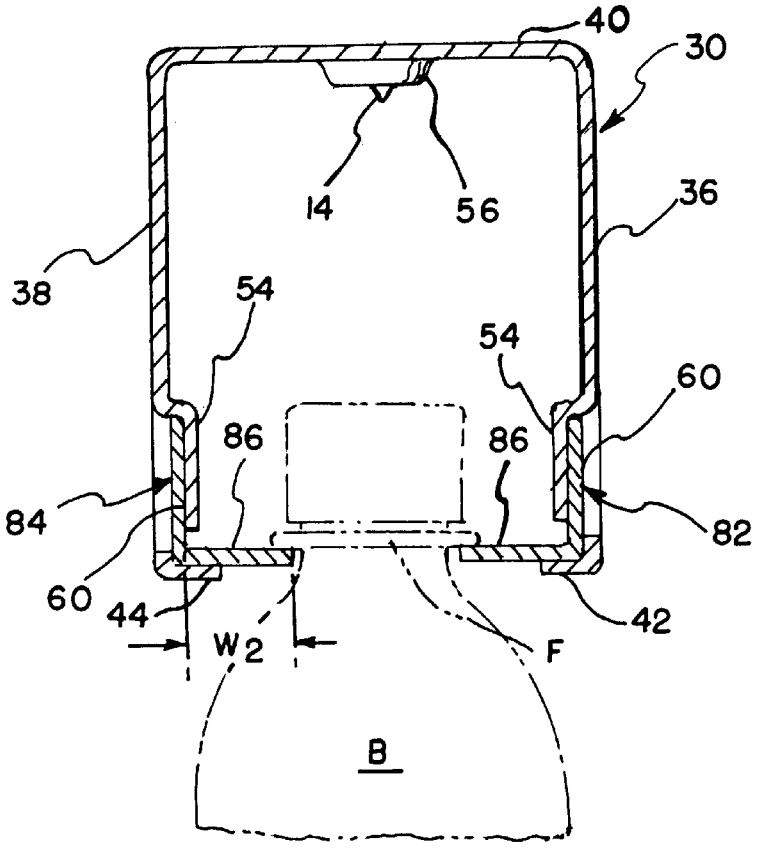
FIG. 5 is a view similar to FIG. 4, showing a different pair of rail members of a greater ledge width being used with the track body in FIG. 4.

The above tracks 22 and 24 can be easily converted into tracks which can accommodate different-sized bottles. To do so, the rail members 32 and 34 are replaced by like rail members having different-sized ledges. Replacement of the rail members can be achieved by pressing the ribs 68 out of the locking apertures 50, withdrawing the rail members 32 and 34 through the forward end opening of the body 30, and inserting a different pair of rail members into the body 30. FIG. 5 shows an example of a converted track assembled from the above-described body 30 and a pair of rail members 82 and 84 having ledges 86 of a larger lateral size "W2" that is greater than the lateral size "W1" (shown in FIG. 4) of the ledges 62. The gap between the rail members 82 and 84 is less than that between the members 32 and 34, and thus the track now is suitable to accommodate smaller-sized bottles such as those having a neck diameter of 28 mm. Except for the lateral size, the rail members 82 and 84 are virtually identical to the rail members 32 and 34, and thus those identical portions of the members 82 and 84 are identified by the same reference numeral.

Figure 7:
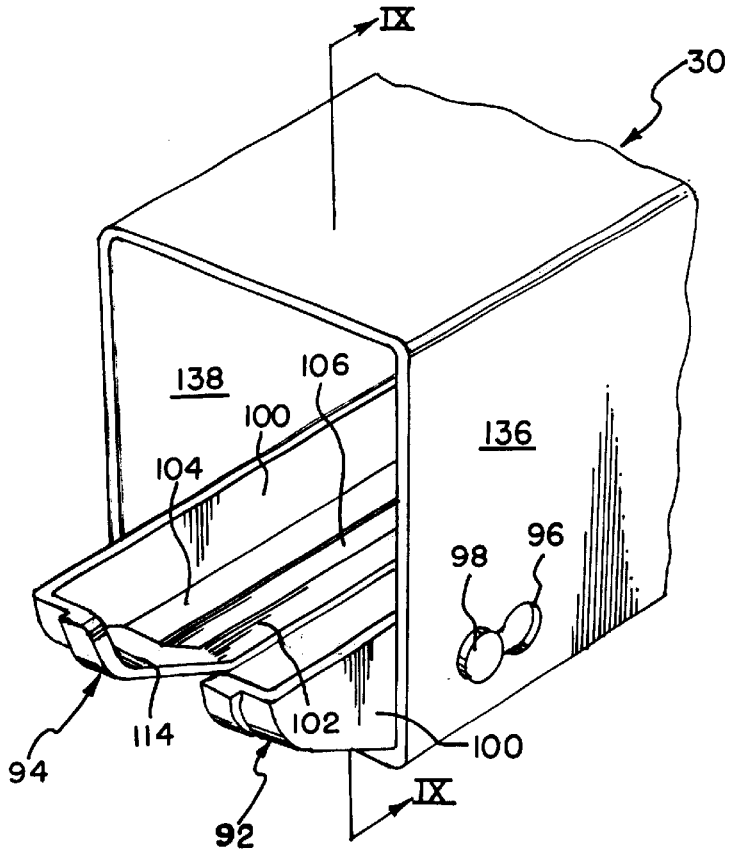
FIG. 7 is a perspective view of the front portion of a track of another embodiment according to the present invention.
Figure 8:
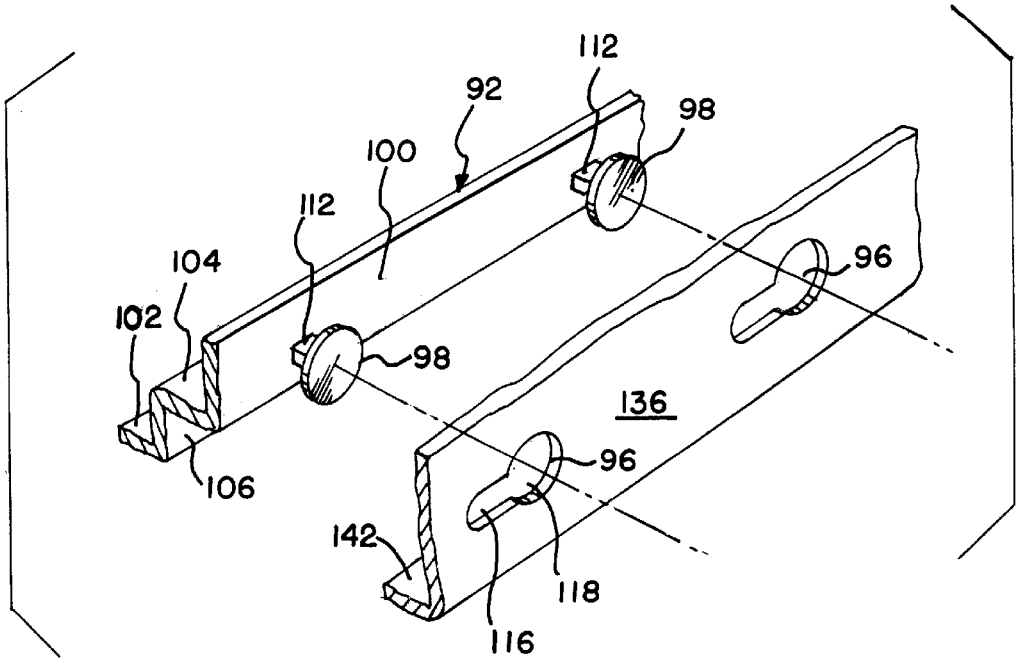
FIG. 8 is a fragmentary perspective view of the attaching means of the track in FIG. 7.
Figure 9:
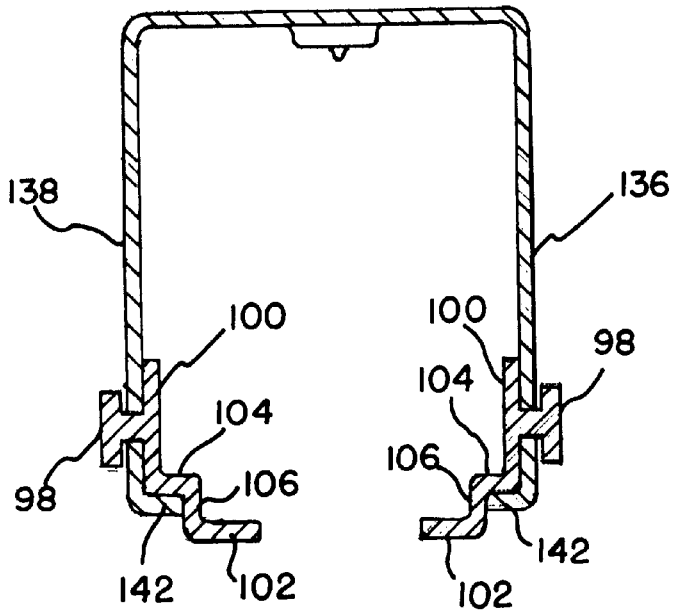
FIG. 9 is a view taken along the line IX—IX in FIG. 7.

FIGS. 7–9 show another embodiment of the present invention, in which the merchandising device differs from that of the foregoing embodiment in that the rail members 92 and 94 have a W-shaped cross section, and the attaching means comprises a number of keyhole apertures 96 and a number of complementary headed projections 98.

Each rail member 92 and 94 has an integral step portion interconnecting the connector panel 100 and the supporting ledge 102. Such an step portion includes a tread panel 104 and a riser panel 106. The tread panel 104 is joined to the connector panel 100 along its lower edge and projects laterally inwardly of the track body 130. The riser panel 106 is joined to the tread panel 104 along the inner edge of the tread panel 104 and extends downward. The ledge 102 is joined to the riser panel 106 along the lower edge of the riser panel 106 and extends laterally inwardly of the track body 130. The connector panels 100 of the rail members 92 and 94 do not have upwardly extending portions; however, sloping ledge sections 114 (only one shown in FIG. 7) are provided at the front ends of the rail members 92 and 94 in a similar manner to the ledge sections 74 in the foregoing embodiment.

The keyhole apertures 96 are formed in the side walls 136 and 138 of the track body 130. They are arranged along the lower edges of each side wall 136 and 138 at equal spacings. Each keyhole aperture 96 is oriented such that its smaller diameter portion 116 is located forwardly of the larger diameter portion 118. The headed projections 98 is formed on the outside surface of the connector panel 100 of each rail member 92 and 94. They are arranged along the length of the respective rail member at spacings equal to those spacings for the keyhole apertures 96.

To attach the rail members 92 and 94 to the track body 130, the rail members 92 and 94 are applied against the inside surfaces of the respective side walls 136 and 138 so that the headed projections 98 are inserted through the larger diameter portions 118. Then the members 92 and 94 are manipulated to slide forwardly of the body 130 to cause the stems 112 of the projections 98 to enter the smaller diameter portions 116, respectively. By this means, the rail members 92 and 94 are locked in position within the track body 130. The step portions of the rail members 92 and 94 snugly fit on the side wall flanges 142 as shown in FIG. 9 wherein the tread panels 104 rest on the side wall flanges 142, and the riser panels 106 extend alongside the inner edges of the side wall flanges 142, respectively. The front ends of the rail members 92 and 94 project forwardly of the front edges of the side walls 136 and 138 and form a stopper of the suspended bottles.

The track of this embodiment can also be converted into a track for different-sized bottles by replacing the rail members 92 and 94 with like rail members having a different ledge size. Detachment of the rail members 92 and 94 can be easily achieved by sliding the rail members 92 and 94 backwardly of the side walls 136 and 138 and withdrawing the projections 98 from the keyhole apertures 96.

Figure 10:
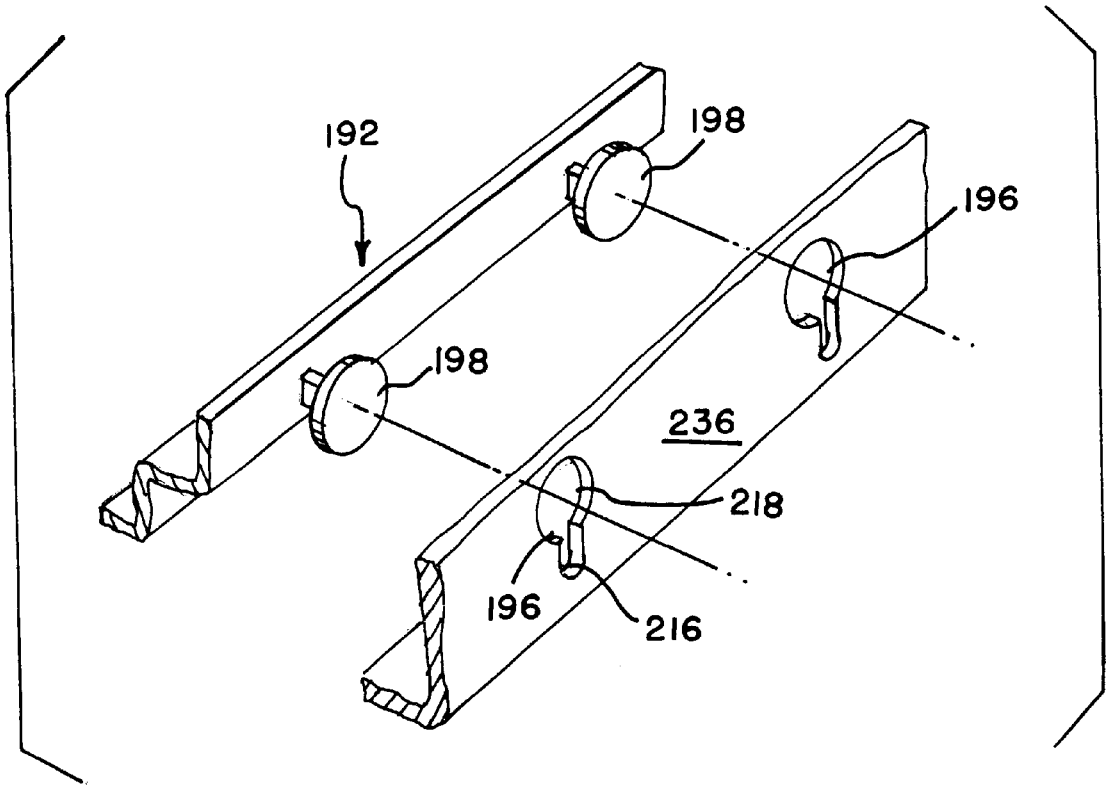
FIG. 10 is a view similar to FIG. 8, showing a modified form of the attaching means in FIG. 8.

FIG. 10 illustrates a modified form of the track in FIGS. 7–9. In this form of the track, the keyhole apertures 196 formed in the side walls 236 have a different orientation. More specifically, each keyhole aperture 196 has a smaller diameter portion 216 located downwardly of the larger diameter portion 218. In order to attach a rail member 192 to the side wall 236, the rail members 192 is caused to slide downwardly following insertion of the headed projections 198 through the larger diameter portions 218 of the keyhole apertures 196.

It will be recognized that many variations may be made to the foregoing within the scope of the present invention. For example, a stopper comprising a pair of leaf springs may be used instead of the stopper 72. Each leaf spring may be secured at near its one end to the outside surface of the upstanding portion 64 of the respective connector panel, and is provided at near its other end with an engaging element. The engaging element extends into the pathway of the bottle within the track. An example of the leaf spring stopper is described in U.S. Pat. No. 5,586,687.

It will be also recognized that the connector panels may be attached to a track body so that they extend alongside the outside surfaces of the track side walls. Attaching means virtually equivalent to those described above may be used to connect such outside rail members to the track body.

What is claimed is:

1. A merchandising device including a row of bottles with each of said bottles having an annular neck flange, and an elongate track for supporting said row of bottles such that said bottles are suspended by said neck flanges thereof for movement along said track and are removable from said track through a front end of said track, said track comprising:

an elongated track body including a pair of opposed elongated side walls extending along longitudinally said track, a top wall interconnecting upper edges of said side walls to form an elongate channel structure, and a pair of track flanges joined to said side walls along lower edges thereof and projecting laterally toward each other, said track flanges being disposed with a gap therebetween;

a pair of rail members attachable to said side walls to be disposed substantially parallel to each other and spaced from each other, each of said rail members comprising a connector panel extending alongside a respective one of said side walls and a supporting ledge joined to and extending along said connector panel, said track flanges projecting laterally toward each other along undersides of said supporting ledges to support said rail members when said rail members are attached to said side walls, said supporting ledges projecting laterally of said connector panels toward each other when attached to said side walls and disposed with a gap therebetween to receive in said gap necks of said bottles such that said bottles are slidably engaged at undersides of said neck flanges with said supporting ledges, said between said supporting ledges being smaller than said gap between said track flanges to accommodate bottles with smaller neck flanges between said supporting ledges than between said track flanges; and means for detachably attaching said connector panels of said rail members to said side walls for installing and removing said rail members.

2. The merchandising device according to claim 1, wherein said attaching means comprises at least one locking element formed on said each rail member and at least one cooperating locking aperture formed in said respective side wall to receive said one locking element of said each rail member.

3. The merchandising device according to claim 2, wherein said at least one locking aperture in said respective side wall is a plurality of keyhole apertures formed along lower edge of said respective side wall, and said at least one locking element of said each rail member is a plurality of headed projections.

4. The merchandising device according to claim 2, wherein said one locking aperture of said respective side wall is formed adjacent to a front edge of said respective side wall, said each rail member has a front end projecting forwardly of said front edge of said respective side wall, and said one locking element of said each rail member is a latch extending rearwardly from said front end of said each rail member to engage perimeter of said one locking aperture in said respective side wall.

5. The merchandising device according to claim 1, wherein each said side wall has an inside surface facing inwardly of said channel structure, and said panel of said each rail member is disposed alongside said inside surface of said respective side wall.

6. A merchandising device including a row of bottles with each of said bottles having an integrally formed annular neck flange, and an elongate track for supporting said row of bottles such that said bottles are suspended by said neck flanges thereof for movement along said track and are removable from said track through a front end of said track, said track comprising:

a single piece track body including a of opposed side walls extending along said track and a top wall interconnecting upper edges of said side walls to form a continuous elongate channel;

a pair of rail members removably received in said channel and disposed alongside and abutting inside surfaces of said side walls to provide a pair of spaced parallel supporting ledges for receiving therebetween necks of said bottles such that said bottles are slidably engaged at undersides of said neck flanges with said ledges; and means for slidably connecting said rail members to said side walls for sliding movement of said rail members along said track.

7. The merchandising device according to claim 6, wherein said connecting means comprises a plurality of slots formed in each of said side walls and arranged longitudinally along each of said side walls and a pair of flanges joined respectively to said side walls along lower edges thereof and extending along undersides of said ledges, said slots in said each side wall are disposed to cooperate with said flange on said each side wall to slidably receive a respective one of said rail members for sliding movement along said track.

8. The merchandising device according to claim 6, wherein said track further comprises connecting means for locking said rail members in said channel structure, said connecting means comprising at least one locking element formed on each of said rail members and at least one cooperating locking aperture having a perimeter and being formed in said respective side wall adjacent to a front edge thereof to receive said one locking element of said each rail member, wherein said each rail member has a front end projecting forwardly of said front edge of said respective side wall, and said one locking element of said each rail member is a latch extending rearwardly from said front end of said each rail member to engage said perimeter of said one locking aperture in said respective side wall.

* * * * *